United States Patent [19]

Conner, Jr. et al.

[11] 4,284,020

[45] Aug. 18, 1981

[54] THREAD MONITOR FOR TEXTILE MACHINES

[75] Inventors: William R. Conner, Jr., Shelbyville, Tenn.; Heinz Hubele, Kaiserslautern; Kurt Petry, Stelzenberg, both of Fed. Rep. of Germany

[73] Assignee: Stahl-Urban Company, Brookhaven, Miss.

[21] Appl. No.: 55,178

[22] Filed: Jul. 6, 1979

[30] Foreign Application Priority Data

Jul. 12, 1978 [DE] Fed. Rep. of Germany ..... 2830534

[51] Int. Cl.[3] ..... D05B 69/36

[52] U.S. Cl. ..... 112/273; 200/61.18

[58] Field of Search ..... 112/273, 278; 66/158-163; 242/29, 37 R, 49; 57/81; 19/0.20-0.25; 28/187, 188; 139/353, 370.2; 200/61.13, 61.14, 61.18

[56] References Cited

U.S. PATENT DOCUMENTS

| | | | |
|---|---|---|---|
| 683,596 | 10/1901 | Eadie et al. | 19/0.25 |
| 2,202,323 | 5/1940 | Sullivan | 139/370.2 |
| 2,251,368 | 8/1941 | Moser | 112/273 |
| 2,747,039 | 5/1956 | Vossen | 112/273 |
| 2,962,992 | 12/1960 | Johnson et al. | 112/273 |
| 3,440,634 | 4/1969 | Maurmann et al. | 139/370.2 |
| 3,611,342 | 10/1971 | Rauben et al. | 66/163 X |
| 3,714,916 | 3/1973 | Saray | 112/273 |
| 3,922,981 | 12/1975 | Hughes | 112/273 |
| 4,075,445 | 2/1978 | Kempf | 66/163 X |
| 4,100,425 | 7/1978 | Ohsawa | 28/187 |

FOREIGN PATENT DOCUMENTS

| | | | |
|---|---|---|---|
| 1914424 | 12/1964 | Fed. Rep. of Germany . | |
| 1226013 | 9/1966 | Fed. Rep. of Germany . | |
| 1918740 | 10/1970 | Fed. Rep. of Germany | 139/370.2 |

*Primary Examiner*—Werner H. Schroeder
*Assistant Examiner*—Andrew M. Falik
*Attorney, Agent, or Firm*—Senniger, Powers, Leavitt and Roedel

[57] ABSTRACT

A thread monitor particularly for a sewing machine having a needle, the monitor comprising a control device operable for stopping the operation of the machine, a thread feeler engageable with the thread supplied to the needle, and a bracket mounting the feeler for movement between a retracted position with respect to the control device and an operative position for actuating the control device for stopping the operation of the machine. The feeler is biased toward its operative position, the bias being greater than the frictional force present between the feeler and its mounting as the machine vibrates during the operation thereof but less than the frictional force present between the feeler and its mounting when the machine is not in operation, so that, upon thread breakage when the machine is in operation, the feeler will move to its operative position for stopping the operation of the machine and, when the machine is not in operation, the feeler remains in retracted position.

11 Claims, 1 Drawing Figure

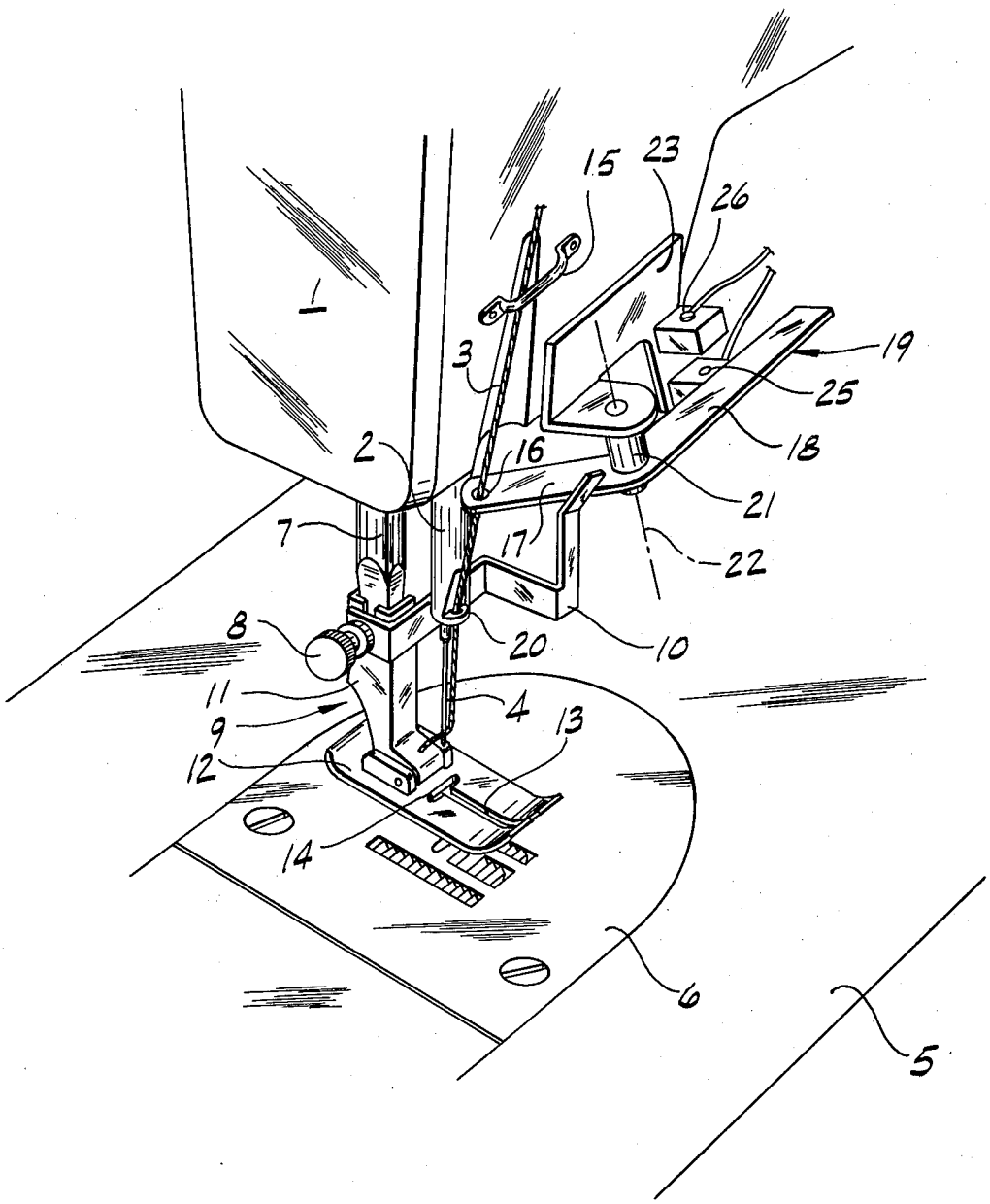
1
2
3
4
5
6
7
8
9
10
11
12
13
14
15
16
17
18
19
20
21
22
23
25
26

THREAD MONITOR FOR TEXTILE MACHINES

BACKGROUND OF THE INVENTION

This invention relates to thread monitors for textile machines, and more particularly to thread monitors for stopping operation of a sewing machine upon breakage of the thread supplied to the needle of the sewing machine. Previously known thread monitors of the type shown in German Auslegeschrift No. 1,226,013 and U.S. Pat. Nos. 2,251,368 and 3,922,981 have a thread feeler supported in an unstable equilibrium (i.e., against a gravity bias) by the thread supplied to the needle of a sewing machine. Upon thread breakage, the feeler drops into its stable equilibrium by its own weight and in this position operates a switch-off mechanism or control means for stopping the operation of the machine.

Other previously known thread monitors of the type shown in German Gebrauchsmuster No. 1,914,424 and U.S. Pat. No. 3,714,916 have a feeler biased into engagement with the thread by a spring or magnetic device. When the machine is in operation, the feeler is kept in a sensing or retracted position by the pull exerted by the thread. When a thread break occurs, the spring or magnetic bias moves the feeler to its operative position for operating the switch-off mechanism or control means.

The disadvantage of these previously known monitors is that when the machine is stopped for reasons other than thread breakage or running out of thread the pull on the thread is relieved and the biased feeler moves to the position for operating the switch-off mechanism the same as if there had been a thread breakage. Thus, in order to resume operation of the machine, the feeler must be moved away from this position, or the control circuit for the drive means to the machine must be designed such that the interruption caused by the feeler will be cancelled when the machine is switched on again.

Another disadvantage is that the end of the thread at the needle remaining after thread trimming is pulled out of the needle eye by the feeler as it moves when the machine is stopped. To prevent this, the end of the thread has in the past been trapped by a thread nipper.

SUMMARY OF THE INVENTION

Among the several objects of this invention may be noted the provision of a thread monitor having a thread feeler which moves to operative position for stopping the operation of the sewing machine only upon running out of thread or thread breakage when the machine is operating, the provision of such a thread monitor which holds the feeler in retracted position relative to the control means while the sewing machine is not in operation, and the provision of such a thread monitor in which the feeler does not pull the end of thread through the eye of the needle when the operation of the machine is stopped.

Briefly, the thread monitor of this invention comprises control means operable for stopping the operation of the machine, a thread feeler engageable with the thread supplied to the needle, and means mounting the feeler for movement between a retracted position with respect to the control means and an operative position for actuating the control means for stopping the operation of the machine. The feeler is biased toward its operative position, the bias being greater than the frictional force present between the feeler and its mounting as the machine vibrates during the operation thereof but less than the frictional force between the feeler and its mounting when the machine is not in operation, so that, upon thread breakage when the machine is in operation, the feeler will move to its operative position for stopping the operation of the machine and when the machine is not in operation, the feeler remains in retracted position.

Other objects and features will be in part apparent and in part pointed out hereinafter.

BRIEF DESCRIPTION OF THE DRAWINGS

The FIG. is a perspective of the thread monitor of this invention shown on a sewing machine.

DESCRIPTION OF THE PREFERRED EMBODIMENTS

As indicated generally in the FIG., a needle bar 2 is mounted on the head 1 of a sewing machine for movement up and down in the usual manner. The needle bar at its lower end carries a needle 4 which, in turn, carries thread 3. In producing a seam, the needle 4 acts together with a sewing hook below a needle plate 6 which is secured to bedplate 5. The machine head 1 also encloses a presser bar 7 which can be raised against spring pressure by a lifting device. Attached to the presser bar 7 by means of a knurled screw 8 is a presser foot 9 and a stop 10 having a vertical arm with an inclined upper portion. The purpose of the stop will be explained later. The presser foot 9 consists of a shank 11 and a shoe 12 which is hinged to the shank 11. The toe portion of the shoe 12 is provided with a thread slot 13 and, next to it, a needle slot 14.

The thread 3, which is unreeled from a thread supply, passes through a thread eyelet 15 on the machine head 1 and then through a thread eyelet 16 of a two-armed feeler 19 from which it passes to a thread eyelet 20 in the needle bar 2 and on to the needle eye. One arm 18 of the feeler 19 is longer and has a greater mass than the other arm 17. Feeler 19 is pivotally mounted in an unbalanced condition on a stud or shouldered pin 21 the longitudinal axis 22 of which is inclined from the vertical and which is secured to a bracket 23 on the machine head 1, the pin 21 having a head at its lower end for supporting the feeler 19 on the sewing machine with the feeler in frictional engagement with and movable on the upper face of the head between its retracted and its operative positions.

Furthermore a light barrier consisting of a source of light 26 and a photocell 25 is mounted on bracket 23 and is connected to the drive motor circuit of the sewing machine. The drive motor is switched off whenever arm 18 of feeler 19 enters the slot between the source of light 24 and photocell 25, thus interrupting the beam of light transmitted to photocell 25.

As feeler 19 is mounted on the inclined pivot stud 21 its arms 17 and 18 have different masses, feeler 19 is kept in an unstable equilibrium and, owing to the force of gravity, tends in the example shown to turn counterclockwise on pivot stud 21. The angle of inclination of pivot stud 21 and the distribution of weight between arms 17 and 18 of feeler 19 have been selected so that the rotational moment of the feeler does not exceed the static frictional force between the feeler and its mounting (i.e., stud 21). As a result of this, the feeler 19 is retained in retracted position with respect to control means as shown in the FIG. when the machine is not in operation so that no force is exerted on the thread tending to pull the end of the thread through the eye of the needle.

Alternatively, the feeler may have arms of equal length and weight and may be biased by a spring or magnetic device. The bias, whether gravity, spring or magnetic, however, is greater than the frictional force between the feeler and the stud as the sewing machine vibrates during its operation. The vibration of the machine during operation is transmitted by the bracket 23 to the pivotal connection between the feeler and the stud, and has the effect of changing the nature of the frictional force present at the connection from static to kinetic friction, and of reducing the magnitude of the frictional forces. Thus, when the machine is in operation, only the engagement of the feeler with the thread 3 prevents the feeler from pivoting under the bias to its actuation position.

In the operation of the thread monitor, the feeler is initially held in retracted position by the vertical arm of the stop 10 and the thread 3, which is unreeled from a thread supply, and is passed through the thread eyelet 15 on the machine head 1, the thread eyelet 16 in the arm 17 of the feeler 19, the thread eyelet 20 on the needle bar 2 and the needle eye. When the presser foot 9 is lowered on to the material, the stop 10 releases the arm 17 of the feeler 19. While the machine is in operation the feeler 19 is retained in its retracted position shown in the drawing by the pull exerted on the thread 3. In retracted position, the arm 18 of the feeler 19 is positioned outside the slot between the source of light 24 and the photoelectric cell 25.

When the sewing machine is stopped for a reason other than thread breakage or running out of thread (e.g., for a seam interruption or at the end of the seam), the tension on the thread 3 is relaxed, but the feeler 19 is still retained in retracted position, because the gravity bias on the arm is not sufficient to overcome the static frictional force between the feeler and the stud 21. Thus, even if the thread is trimmed, the end of the thread will not be pulled out of the needle eye by the feeler. However if the thread breaks while the sewing machine is running, the frictional force between the feeler 19 and stud 21 is overcome by the bias, and the feeler is pivoted counter-clockwise about inclined stud 22, as shown in the FIG., until the arm 18 of the feeler 19 enters the slot between the source of light 24 and photoelectric cell 25 and interrupts the beam of light, thus activating the control means for switching off the machine drive and stopping the machine.

As presser foot 9 is raised, stop 10 is raised likewise. As a result of this movement, the inclined upper portion of the arm of the stop 10 slides along the arm 17 of the feeler 19, thus returning the feeler 19 to retracted position, as shown in the FIG., and the arm of the stop holds the feeler in this position against inadvertent movement until the presser foot has been lowered again.

We claim:

1. A thread monitor for a sewing machine having a needle, said monitor comprising control means operable for stopping the operation of the machine, a thread feeler engageable with the thread supplied to the needle, and means mounting the feeler for movement between a retracted position with respect to the control means and an operative position for actuating the control means for stopping the operation of the machine, said mounting means comprising means for supporting the feeler on the sewing machine with the feeler in frictional engagement with said supporting means and movable thereon between its said positions, said feeler being biased toward its operative position and adapted to be held in its retracted position against the bias by the thread, the bias being greater than the frictional force present between the feeler and said supporting means as the machine vibrates during the operation thereof but less than the frictional force present between the feeler and said supporting means when the machine is not in operation, so that, upon thread breakage when the machine is in operation, the feeler will move to its operative position for stopping the operation of the machine and, when the machine is not in operation, the feeler remains in retracted position.

2. A thread monitor as set forth in claim 1 wherein the mounting means pivotally mounts the feeler for swinging movement between its retracted and operative positions.

3. A thread monitor as set forth in claim 2 wherein the feeler is pivotable about an axis inclined from the vertical.

4. A thread monitor as set forth in claim 3 wherein the feeler comprises two arms extending on opposite sides of the axis, one arm being longer and having a greater mass than the other arm and biasing the feeler toward its operative position.

5. A thread monitor as set forth in claim 3 wherein the mounting means comprises a bracket secured to the sewing machine for supporting the control means and having a shouldered pin about which the feeler pivots, the pin extending along said inclined axis.

6. A thread feeler as set forth in claim 5 wherein the pin has a head at its lower end, the feeler being in frictional engagement with and movable on the upper face of the head.

7. A thread monitor as set forth in claim 1 further comprising a stop movable toward and away from a position in which the stop is engageable with the feeler for preventing movement of the feeler to its operable position.

8. A thread monitor as set forth in claim 1 wherein the control means comprises a light source and a photoelectric cell operable to stop the operation of the sewing machine upon the feeler moving to operative position blocking the light to the photoelectric cell.

9. A thread monitor for a sewing machine having a needle, a vertically movable presser bar and a foot adjacent the needle, said monitor comprising control means operable for stopping the operation of the machine, a thread feeler engageable with the thread supplied to the needle, and means mounting the feeler for movement between a retracted position with respect to the control means and an operative position for actuating the control means for stopping the operation of the machine, said feeler being biased toward its operative position, the bias being greater than the frictional force present between the feeler and its mounting as the machine vibrates during the operation thereof but less than the frictional force present between the feeler and its mounting when the machine is not in operation, so that, upon thread breakage when the machine is in operation, the feeler will move to its operative position for stopping the operation of the machine and, when the machine is not in operation, the feeler remains in retracted position, said thread monitor further comprising a stop movable toward and away from a position in which the stop is engageable with the feeler for preventing movement of the feeler to its operable position, the stop being mounted on the presser bar and being movable therewith toward and away from said position where the stop is engageable with the feeler.

10. A thread monitor as set forth in claim 9 wherein the stop has a generally vertical arm.

11. A thread monitor as set forth in claim 10 wherein the arm has an inclined upper portion engageable with the feeler for moving the feeler away from its operative position toward its retracted position as the presser foot is moved upwardly.

* * * * *